US005314257A

United States Patent [19]

Cheng

[11] Patent Number: 5,314,257

[45] Date of Patent: May 24, 1994

[54] PRINTER CARTRIDGE ASSEMBLY

[76] Inventor: Wei T. Cheng, 1540 New Haven Rd., Naugatuck, Conn. 06770

[21] Appl. No.: 63,520

[22] Filed: May 18, 1993

[51] Int. Cl.[5] ..... B41J 31/16

[52] U.S. Cl. ..... 400/199; 400/202.3

[58] Field of Search ..... 400/199, 197, 196.1, 400/200, 202.1-202.4, 207, 208, 201; 118/322, 268

[56] References Cited

U.S. PATENT DOCUMENTS

| | | | |
|---|---|---|---|
| 3,981,387 | 9/1976 | Gottschlich | 197/168 |
| 4,153,378 | 5/1979 | Scherrer et al. | 400/196.1 |
| 4,636,097 | 1/1987 | Goubeaux | 400/196.1 |
| 4,707,155 | 11/1987 | Burkhead et al. | 400/199 |
| 4,882,593 | 11/1989 | Touma et al. | 400/202.4 |
| 5,054,943 | 10/1991 | Cheng | 400/202.3 |
| 5,207,519 | 5/1993 | Debreczenyi | 400/202.4 |

FOREIGN PATENT DOCUMENTS

| | | | |
|---|---|---|---|
| 0246270 | 10/1988 | Japan | 400/199 |
| 4348980 | 12/1992 | Japan | 400/202.4 |
| 2190357 | 11/1987 | United Kingdom | 400/196.1 |

*Primary Examiner*—Edgar S. Burr
*Assistant Examiner*—Anthony H. Nguyen
*Attorney, Agent, or Firm*—St. Onge Steward Johnston & Reens

[57] ABSTRACT

A printer cartridge assembly includes an inking apparatus for receiving ink from an applicator and transferring the ink to a ribbon from an applicator via an inking pulley and belts. The inking apparatus includes a retainer carriage that is shaped to prevent ribbons from entangling in the apparatus, and drive, trailing and inking pulleys with connecting belts that hold the pulleys to the inking assembly so it can be conveniently handled during assembly. The trailing pulley is snap fitted into a notch in the retainer carriage and the inking pulley is retained in a notch in the retainer carriage by the interference of the trailing pulley with the inking pulley.

25 Claims, 3 Drawing Sheets

PRINTER CARTRIDGE ASSEMBLY

FIELD OF THE INVENTION

The present invention relates to the field of printer ribbon cartridges wherein ink is applied to an endless ribbon.

BACKGROUND OF THE INVENTION

Printer ribbon cartridges for high speed printers are typically used with impact printers such as dot matrix printers, which cause extensive and rapid wear of the ribbon. These cartridges typically have an endless ribbon that is continuously inked. The ink is fed by gravity and capillary action from an inkwell or reservoir containing a hard felt mat through a felt wick to a brush that presses against a roller wheel used to advance the ribbon.

It has been found that such prior art printer cartridges are unsatisfactory in that they suffer from inconsistent print quality over the life of the cartridge. The print quality of prior art cartridges often begins to deteriorate after as little as several hours of continuous use, and continues deteriorating over the next several hours until the print becomes unreadable. This deterioration in print quality is attributable to wear of the ribbon, which becomes less capable of absorbing and transmitting ink as it wears. I have invented a solution to this problem as disclosed and claimed in my U.S. Pat. No. 5,054,943, issued Oct. 8, 1991, the entire disclosure of which is hereby incorporated by reference. This patent application builds upon the solutions disclosed in my prior patent and provides a structure for a printer cartridge that is simple and inexpensive to manufacture.

SUMMARY OF THE INVENTION

It is an object of the invention to provide a printer cartridge that has a substantially long operating life, with consistent print quality throughout its operating life, and which is simple to manufacture and assemble.

In accordance with one embodiment of the invention, an inking apparatus comprises a retainer carriage, and drive, trailing and inking pulleys, and a belt fitted around the drive and trailing pulleys that retains the drive and trailing pulleys to the retainer carriage. The trailing pulley is preferably snap fitted into a notch in the retainer carriage, with the inking pulley located sufficiently closely to the snapped in trailing pulley that the inking pulley is retained in a notch in the retainer carriage by the interference of the trailing pulley with the inking pulley. The assembly provides a self-retaining assembly that can be handled without loss of the pulleys.

The retainer carriage is preferably generally L-shaped with a generally rounded outer side, a perpendicular portion of which serves as a barrier to prevent a printer ribbon from tangling in the pulleys.

Rotation of the drive pulley causes the retainer carriage to pivot to press the inking pulley against an ink applicator, and also advances the belt which is in frictional contact with the inking pulley so that the inking pulley rotates and receives a film of ink from the applicator which film of ink is transferred to the belt. The belts press against the ribbon and the ink is transferred to the ribbon material concurrently with the advancement of the ribbon material.

A feature of the preferred embodiment of the invention are ink drainage slots around an outer perimeter edge of cupped ends of the inking pulley.

The applicator preferably comprises a generally T-shaped wool felt wick that is folded along a center line thereof and which is in capillary contact with an ink reservoir.

DETAILED DESCRIPTION OF THE INVENTION

Figure 1:
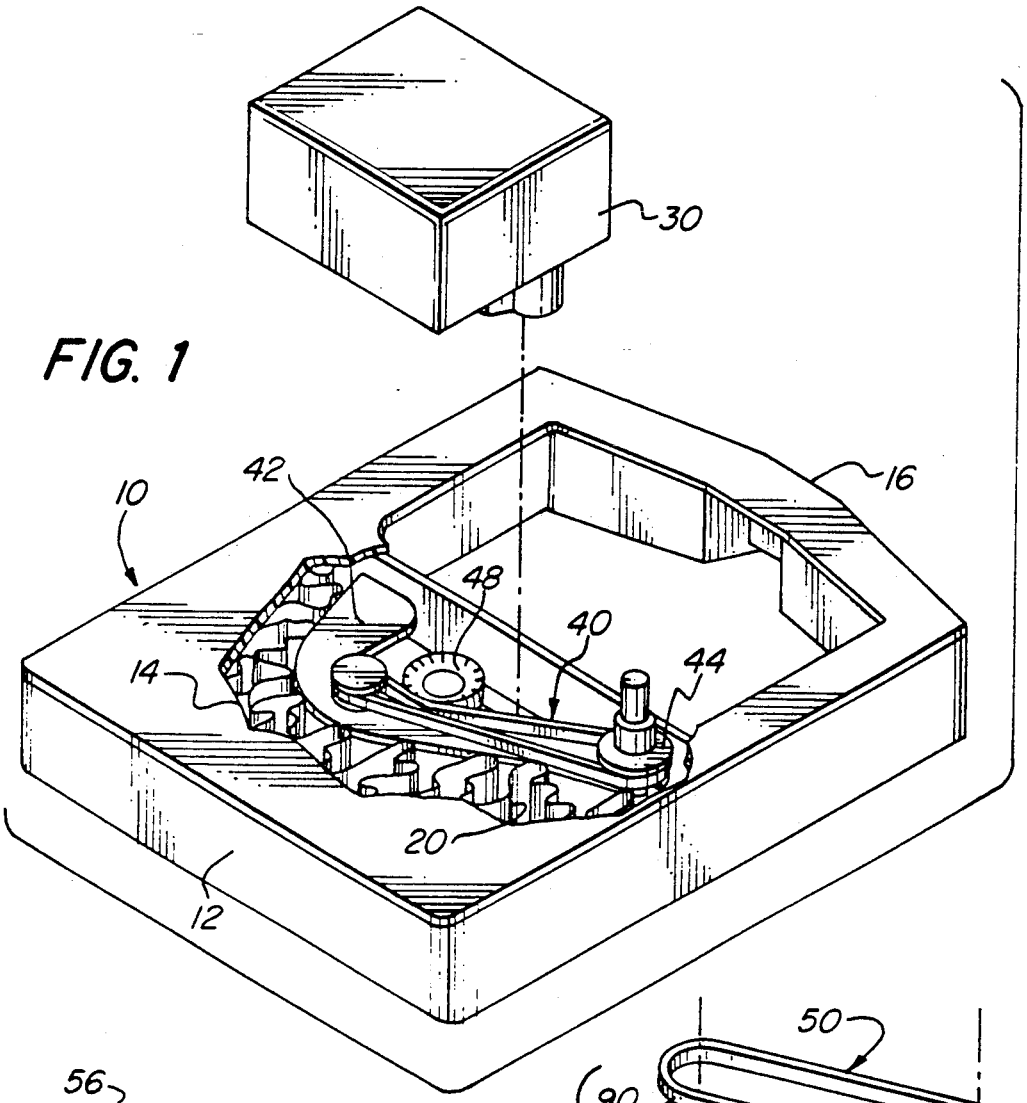
FIG. 1 is an exploded perspective view of a printer cartridge in accordance with the invention.
Figure 2:
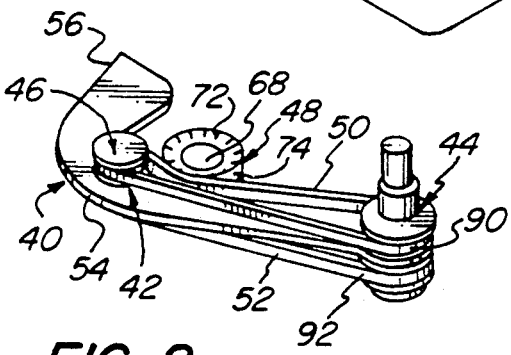
FIG. 2 is a perspective view of an assembled inking apparatus in accordance with the invention.
Figure 3:
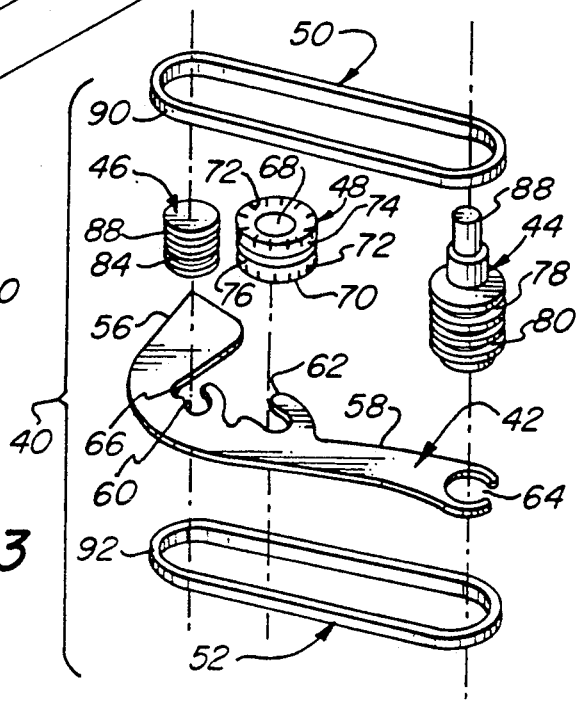
FIG. 3 is an exploded perspective view of the inking apparatus of FIG. 2.

Referring now to FIGS. 1–8, where like numbers in the description and drawings refer to the same elements, a printer cartridge is shown generally at 10. Cartridge 10 comprises a cartridge case 12, an endless printer ribbon 20 having a character transferring zone 22, an ink reservoir 30, an ink wick 32 for transferring ink from the ink reservoir 30, and an inking apparatus 40 for simultaneously advancing the ribbon 20, receiving ink from the ink wick 32 and applying ink to the ribbon 20 adjacent its character transferring central zone 22.

Figure 5:
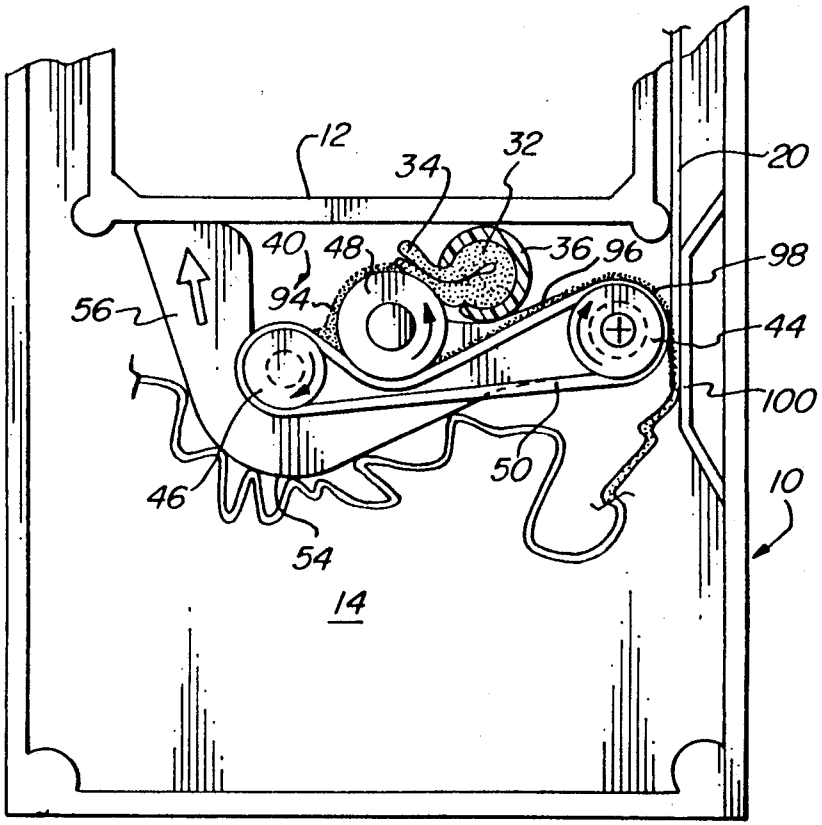
FIG. 5 is a top plan view of a printer cartridge inking apparatus in accordance with the invention.
Figure 4:
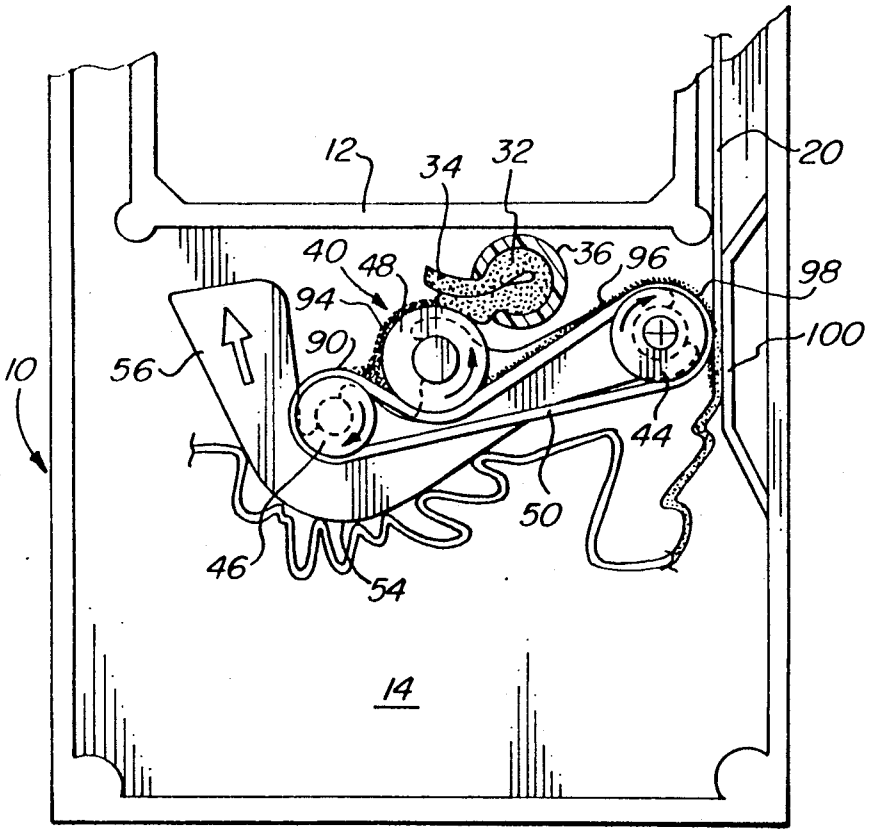
FIG. 4 is a top plan view of a printer cartridge inking apparatus in accordance with the invention.
Figure 8:
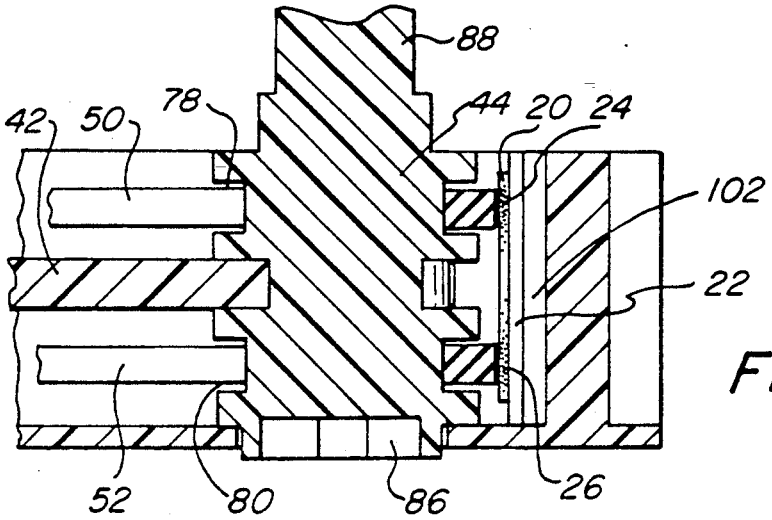
FIG. 8 is a cross-sectional view of one end of the inking apparatus shown installed in a cartridge case for applying ink to a ribbon.

The cartridge case 12 will be sized and shaped to fit the particular printer to which it is adapted. The ribbon 20 will have a substantial length. Cartridge case 12 is arranged such that a given section of the ribbon 20 is inked by the inking apparatus 40, and then passed to a storage area 14 where the ink, which has been applied to the ribbon 20 in its upper and lower zones 24 and 26, can diffuse to the ribbon central zone 22, as shown in FIGS. 4, 5, and 8. The ribbon section then passes through the printing area 16 which is where a print head will impact the ribbon to apply characters to a sheet material such as paper. The ribbon section then returns to the inking apparatus 40. The ribbon 20 is thus continuously inked and used until the ink supply is depleted.

Preferably, a mechanical means to keep the ink in suspension is contained within the ink reservoir 30. This mechanical means preferably comprises a porous sponge material. The sponge material is preferably a polymer foam.

Figure 6:
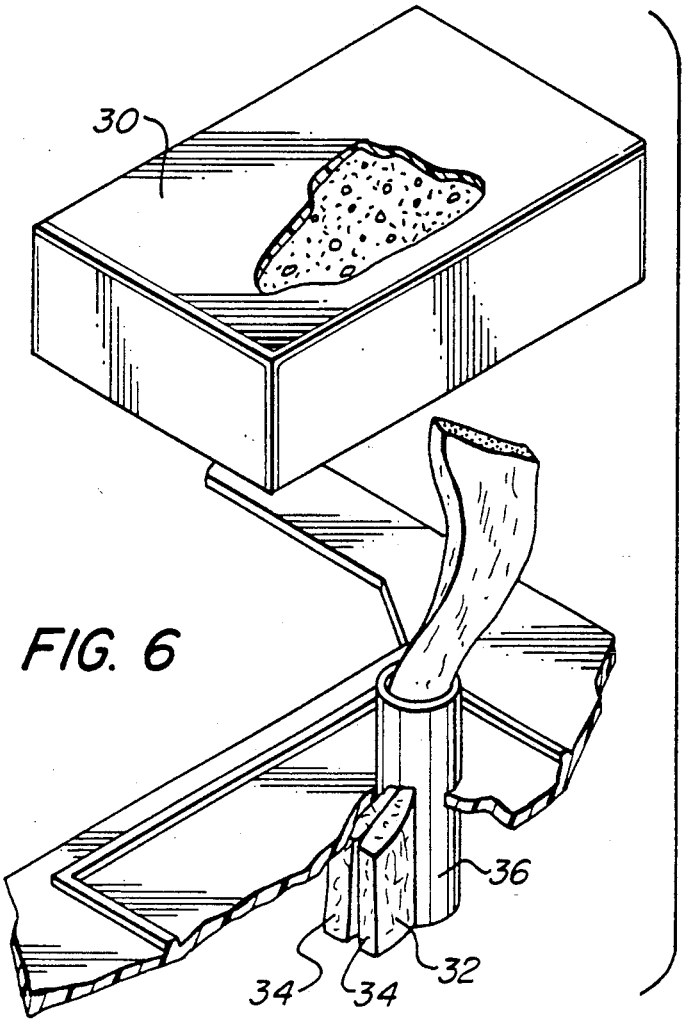
FIG. 6 is an exploded perspective view of an ink reservoir of a printer cartridge in accordance with the invention.
Figure 7:
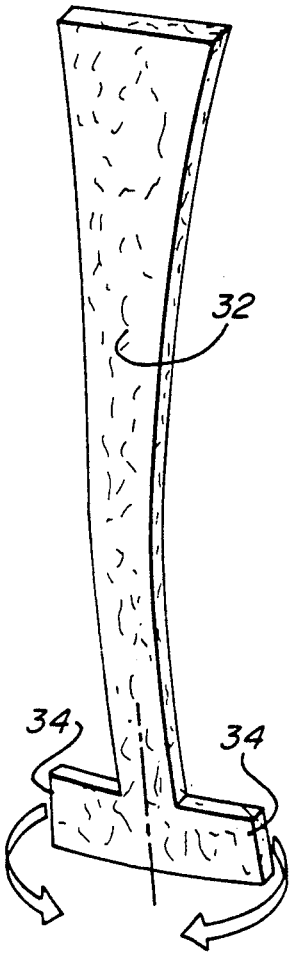
FIG. 7 is a perspective view of a wick connecting an ink reservoir to an inking apparatus in a printer cartridge.

Ink applicator 32 is shown in FIGS. 6 and 7, and comprises a wool felt wick which is generally T-shaped and folded along a center line thereof to form applicator tips 34. Applicator tips 34 extend radially from a slot in tube 36 that contains the applicator 32 within the case 12.

Inking apparatus 40 is shown in FIGS. 1-5, and comprises a retainer carriage 42, a drive pulley 44, a trailing pulley 46, an inking pulley 48, and belts 50 and 52. Retainer carriage 42 preferably has a plurality of semi-circular notches for receiving the pulleys.

Retainer carriage 42 is generally L-shaped with a generally rounded outer side 54. A perpendicular portion 56 of the retainer carriage 42 serves as a barrier to prevent ribbon 20 from tangling in the pulleys.

Each of the pulleys 44, 46, and 48 generally comprise two disks connected by a rod to form a barbell shaped apparatus. The pulleys are preferably formed from a polymeric material.

Trailing pulley 46 and inking pulley 48 are mounted to the retainer carriage 42 at an inner side 58. Trailing pulley 46 is rotatably fitted in semi-circular notch 60. Inking pulley 48 seats in semi-circular notch 62. Drive pulley 44 is rotatably fitted into semi-circular notch 64. Notch 64 and the drive pulley 44 are located on one end of the retainer carriage 42. The trailing pulley 46 is located at the intersection 66 of the two parts of the L-shaped retainer carriage 42. Inking pulley 48 is located between drive pulley 44 and trailing pulley 46.

Preferably, at least the notch 60 for receiving trailing pulley 46 is sized so that trailing pulley 46 snaps into and is retained in notch 60. Notch 62 for receiving inking pulley 48 is located adjacent to notch 60 for receiving trailing pulley 46 so that when the pulleys 46, 48 are placed in their respective notches, trailing pulley 46 when snapped in place interferes with the removal of inking pulley 48 from the retainer carriage 42. This prevents inking pulley 48 from separating from the retainer carriage 42 so that the retainer carriage can be handled for subsequent assembly without loss of the pulleys 46 and 48.

It is to be appreciated that the inking pulley 48 is preferably given a range of floating movement so that it can fit itself against applicator 32 despite variations in the applicator 32 as it becomes worn through use. Consequently, it is desirable to be able to retain the inking pulley 48 loosely to the retainer 42 so it can float within a desired range of positions.

Inking pulley 48 is provided with cupped end surfaces 68 and 70, and drainage slots 72 are located around the perimeter edge of at least the cupped end 68 which will be oriented vertically upward when the cartridge 10 is installed in a printer. The ink drainage slots prevent an accumulation and build-up of dried ink that could become caught in the moving parts and interfere with the printing operations of the printer. Inking pulley 48 preferably has ribbed radial outer surfaces 74 and 76 to enhance ink transport.

Drive and trailing pulleys 44 and 46 are provided with belt receiving channels 78, and 80, and 82 and 84, respectively, for receiving and holding at least one, and preferably two belts 50 and 52 in parallel, spaced apart positions. Belts 50 and 52 are mounted in the belt receiving channels. Belts 50 and 52 retain the drive pulley 44 as well as the trailing pulley 46 to the retainer carriage 42 to create a self-retaining assembly that can be handled without loss of the pulleys 44 and 46.

Belts 50 and 52 are preferably formed of natural or synthetic rubber materials capable of retaining a film of ink, and are capable of receiving a film of ink from the inking pulley 48 and transporting the film of ink to the ribbon 20 where the ink is deposited on the ribbon 20 during the concurrent advancement and ink transfer shown in FIG. 8.

The use of two belts is desirable to reduce wear and tear on the central character transferring zone 22 of the ribbon 20. The ink received by the belts 50 and 52 from the inking pulley 48 is applied only to the upper and lower zones 24 and 26 of the ribbon 20, as seen in FIG. 8, and the ink then permeates to the central zone 22. However, it is to be appreciated that the present invention is not limited to the use of just two belts and that other combinations of moving surfaces may be employed to obtain the desired result.

The inking apparatus 40 is adapted to be engaged by a source of torque, which will be provided by the printer in which the cartridge is mounted. In one embodiment shown in FIGS. 1, 4, and 5, the inking apparatus 40 is provided with a cross-slotted cavity 86 in the base of drive pulley 44, which cavity will receive a matching drive shaft when the cartridge is mounted in a printer. Other means for engagement may be provided dependent on the printer design. In addition, a shaft 88 is preferably provided on drive pulley 44, to permit the user to manually provide torque to advance ribbon 20 in cartridge 10.

The torque provided to the inking apparatus 40 either manually or by the printer will rotate the drive pulley 44, and also cause the entire inking apparatus 40 to pivot to press against applicator 32.

The rotation of the drive pulley 44 causes the belts 50 and 52 and trailing pulley 46 to rotate in the same direction as the direction of rotation of the drive pulley 44. Outer surfaces 90 and 92 of belts 50 and 52 contact the the outer surfaces 74 and 76 of inking pulley 48 to drive inking pulley 48 to cause it to rotate in the opposite direction as the direction of rotation of the drive pulley 44. The inking pulley 48 will be pressed against the applicator 32 and each surface 74 and 76 thereof will receive a film of ink 94 from the applicator 32. The inking pulley 48 will transport films of ink 94 to the belts 50 and 52. Belts 50 and 52 will receive films of ink 96 from the inking pulley 48 and transfer the films of ink 96 to the ribbon material 20 at a position 98 remote from the position of the inking pulley 48. The belts 50 and 52 transfer the films of ink 96 to the ribbon 20 concurrently with the advancement of the ribbon 20 in case 12.

An opposing surface 100 is preferably provided to support ribbon 20 where it is contacted by the belts 50 and 52. In FIG. 9, the opposing surface is a flexible metal strip 102 fixed in place opposite from and in contact the drive pulley 44.

Accordingly, the present invention provides a new and improved ink cartridge and inking apparatus that is easy to manufacture and assemble yet which also operates to provide a continuous flow of ink until the ink reservoir is exhausted.

It is to be appreciated that the foregoing is illustrative and not limiting of the invention, and that various changes and modifications to the preferred embodiments described above will be apparent to those skilled in the art. Such changes and modifications can be made without departing from the spirit and scope of the present invention, and it is therefore intended that such changes and modifications be covered by the following claims.

I claim:

1. An inking apparatus for applying a film of ink received from an applicator operably connected to a source of ink, to a ribbon material, comprising:

a retainer carriage;

a drive pulley rotatably fitted to one end of said retainer carriage;

a trailing pulley rotatably mounted to said retainer carriage and separated from said drive pulley;

an inking pulley rotatably mounted on said retainer carriage between said drive pulley and said trailing pulley and positioned to permit an outer perimeter of said inking pulley to contact the applicator and receive a film of ink from the applicator;

said drive pulley and said trailing pulley being provided with at least one belt receiving channel;

at least one endless belt having inner and outer surfaces, said belt being mounted on and extending around said drive and trailing pulley wheels in said belt receiving channels, said belt retaining said drive and trailing pulleys to said retainer carriage to create a self-retaining assembly that can be handled without loss of said pulleys, said outer surface of said belt frictionally contacting an outer perimeter of said inking pulley to drive said inking pulley and to receive a film of ink from said inking pulley and transfer said film of ink to the ribbon material at a position remote from the position of the inking pulley.

2. An inking apparatus in accordance with claim 1, wherein said inking pulley is provided with drainage slots around an outer perimeter edge thereof.

3. An inking apparatus in accordance with claim 2, wherein said inking pulley is provided with cupped end surfaces.

4. An inking apparatus in accordance with claim 1, wherein said retainer carriage is provided with a barrier arm extending generally perpendicularly to said retainer carriage to prevent the ribbon from tangling in said pulleys.

5. An inking apparatus in accordance with claim 4, wherein said retainer carriage is generally L-shaped with a generally rounded outer side.

6. An inking apparatus in accordance with claim 5, wherein said trailing pulley and said inking pulley are mounted to said retainer carriage at an inner side thereof.

7. An inking apparatus in accordance with claim 6, wherein said trailing pulley and said inking pulley are mounted to said retainer carriage by seating said pulleys in semi-circular notches in said inner side of said retainer carriage, said notches being sized whereby at least a notch for receiving said trailing pulley is sufficiently sized wherein said trailing pulley snaps into and is retained in said notch.

8. An inking apparatus in accordance with claim 7, wherein said notches for receiving said trailing pulley and said inking pulley are located sufficiently closely together whereby said trailing pulley when snapped in said notch for receiving said trailing pulley prevents said inking pulley from separating from said retainer carriage.

9. An inking apparatus in accordance with claim 1, wherein the ribbon material has an upper zone, a lower zone and a middle zone, and wherein there are two said endless belts, and said drive and trailing pulleys each have two belt receiving channels on opposite faces of said retainer carriage, said endless belts being mounted on and extending around said pulleys in said belt receiving channels in parallel, spaced apart positions, said two endless belts receiving a film of ink from said inking pulley and each transferring said film of ink to the ribbon material in upper and lower zones of the ribbon material.

10. An inking apparatus in accordance with claim 1, further comprising a generally T-shaped wool felt wick applicator folded along a center line thereof.

11. An inking apparatus in accordance with claim 1, further comprising: a resilient opposing surface located against said drive pulley and belts with said ribbon therebetween.

12. An inking apparatus in a printer cartridge for applying a film of ink received from an applicator operably connected to a source of ink, to a ribbon material, comprising:

a retainer carriage;

a drive pulley rotatably mounted at one end of said retainer carriage;

a trailing pulley rotatably mounted to said retainer carriage and separated from said drive pulley;

an inking pulley rotatably mounted on said retainer carriage between said drive pulley and said trailing pulley and positioned to permit an outer perimeter of said inking pulley to contact the applicator and receive a film of ink from the applicator;

said drive pulley and said trailing pulley being provided with at least one belt receiving channel;

said retainer carriage being generally L-shaped with a generally rounded outer side, a perpendicular portion of which serves as a barrier to prevent the ribbon from tangling in said pulleys, said trailing pulley and said inking pulley being mounted to said retainer carriage at an inner side thereof by seating said pulleys in semi-circular notches in said inner side of said retainer carriage;

at least one endless belt having inner and outer surfaces, said belt being mounted on and extending around said drive and trailing pulleys in said belt receiving channels, said belt retaining said drive and trailing pulleys to said retainer carriage to create a self-retaining assembly that can be handled without loss of said pulleys, said outer surface of said belt contacting an outer perimeter of said inking pulley to drive said inking pulley and to receive a film of ink from said inking pulley and transfer said film of ink to the ribbon material at a position remote from the position of the inking pulley;

wherein rotation of said drive pulley causes said inking pulley to be pressed against said applicator and to receive a film of ink which film of ink is transferred to said belt and subsequently transferred to the ribbon material concurrently with the advancement of the ribbon material.

13. An inking apparatus in accordance with claim 12, said notches being sized whereby at least a notch for receiving said trailing pulley is sufficiently sized wherein said trailing pulley snaps into and is retained in said notch, said notches for receiving said trailing pulley and said inking pulley being located sufficiently closely together whereby said trailing pulley when snapped in said notch for receiving said trailing pulley prevents said inking pulley from separating from said retainer carriage.

14. An inking apparatus in accordance with claim 13, wherein said inking pulley is provided with cupped end surfaces and drainage slots around an outer perimeter edge thereof.

15. An inking apparatus in accordance with claim 14, wherein the ribbon material has an upper zone, a lower zone and a middle zone, and wherein there are two said endless belts and said drive and trailing pulleys each have two belt receiving channels on opposite faces of said retainer carriage, said endless belts being mounted on and extending around said pulleys in said belt receiving channels in parallel, spaced apart positions, said two endless belts receiving a film of ink from said inking pulley and each transferring said film of ink to the ribbon material in upper and lower zones of the ribbon material.

16. An inking apparatus in accordance with claim 15, further comprising: a resilient opposing surface located against said drive pulley and belts with said ribbon therebetween.

17. An inking apparatus in accordance with claim 13, wherein said applicator comprises a generally T-shaped wool felt wick that is folded along a center line thereof.

18. A printer cartridge, comprising:

a cartridge case;

a printer ribbon contained in said cartridge case, said ribbon having an upper zone, a lower zone, and a character transferring middle zone;

an ink reservoir having a predetermined quantity of ink retained in suspension therein;

an ink wick for transferring ink from said ink reservoir including a porous applicator extending into said cartridge case; and an inking apparatus, including a retainer carriage, a drive pulley rotatably mounted at one end of said retainer carriage and being rotatably fixed in said cartridge case, means for engagement of said drive pulley with a rotational driving element, a trailing pulley rotatably mounted to said retainer carriage and separated from said drive pulley, an inking pulley rotatably mounted on said retainer carriage between said drive pulley and said trailing pulley and positioned to permit an outer perimeter of said inking pulley to contact the applicator and receive a film of ink from the applicator, said drive pulley and said trailing pulley being provided with at least one belt receiving channel;

said retainer carriage being generally L-shaped with a generally rounded outer side, a perpendicular portion of which serves as a barrier to prevent the ribbon from tangling in said pulleys;

said trailing pulley and said inking pulley being mounted to said retainer carriage at an inner side thereof;

at least one endless belt having inner and outer surfaces, said belt being mounted on and extending around said drive and trailing pulleys in said belt receiving channels, said belt retaining said drive and trailing pulleys to said retainer carriage to create a self-retaining assembly that can be handled without loss of said pulleys, said outer surface of said belt contacting an outer perimeter of said inking pulley to drive said inking pulley and to receive a film of ink from said inking pulley and transfer said film of ink to the upper or lower zone of the ribbon material;

said inking pulley having cupped end surfaces and drainage slots around an outer perimeter edge thereof;

wherein rotation of said drive pulley causes said retainer carriage to pivot to press said inking pulley against the applicator and further, to advance said belt to rotate said inking pulley which receives a film of ink from said applicator which film of ink is transferred to said belt and subsequently transferred to the ribbon material concurrently with the advancement of the ribbon material.

19. A printer cartridge in accordance with claim 18, wherein said trailing and inking pulleys are seated in notches in said inner side of said retainer carriage, said notches being sized whereby said notch for receiving said trailing pulley is sufficiently sized wherein said trailing pulley snaps into and is retained in said notch, said notches for receiving said trailing pulley and said inking pulley being located sufficiently closely together whereby said trailing pulley when snapped in said notch for receiving said trailing pulley prevents said inking pulley from separating from said retainer carriage.

20. A printer cartridge in accordance with claim 19, wherein said drive and trailing pulleys each have two belt receiving channels and there are two said endless belts mounted on said pulleys in said belt receiving channels in parallel, spaced apart positions, said two endless belts receiving a film of ink from said inking pulley and each transferring said film of ink to the ribbon material in upper and lower zones of the ribbon material.

21. A printer cartridge in accordance with claim 20, further comprising: a resilient opposing surface located against said drive pulley and belts with said ribbon therebetween.

22. A printer cartridge in accordance with claim 21 wherein said applicator comprises a generally T-shaped wool felt wick that is folded along a center line thereof.

23. An inking apparatus for use in a printer cartridge, comprising:

a retainer carriage having a plurality of semi-circular notches for receiving a plurality of pulleys;

a drive pulley rotatably fitted to one notch in one end of said retainer carriage;

a trailing pulley rotatably mounted to another notch in said retainer carriage;

said drive pulley and said trailing pulley being provided with at least one belt receiving channel;

at least one endless belt mounted in said belt receiving channels of said drive and trailing pulleys, said belt retaining said drive and trailing pulleys to said retainer carriage to create a self-retaining assembly that can be handled without loss of said pulleys, and further comprising an inking pulley rotatably mounted in a third one of said plurality of semi-circular notches on said retainer carriage between said drive pulley and said trailing pulley.

24. An inking apparatus in accordance with claim 23, said notches being sized whereby at least a notch for receiving said trailing pulley is sufficiently sized wherein said trailing pulley snaps into and is retained in said notch, said notches for receiving said trailing pulley and said inking pulley being located sufficiently closely together whereby said trailing pulley when snapped in said notch for receiving said trailing pulley prevents said inking pulley from separating from said retainer carriage.

25. An inking apparatus in accordance with claim 24, said inking pulley being provided with cupped end surfaces and drainage slots around an outer perimeter edge thereof.

* * * * *